US011549658B1

(12) United States Patent
Murphy

(10) Patent No.: US 11,549,658 B1
(45) Date of Patent: Jan. 10, 2023

(54) BAND FOR COVER OR DECORATION

(71) Applicant: SEAMS SHADY LLC, Naples, FL (US)

(72) Inventor: Jennifer L Murphy, Naples, FL (US)

(73) Assignee: SEAMS SHADY LLC, Naples, FL (US)

( * ) Notice: Subject to any disclaimer, the term of this patent is extended or adjusted under 35 U.S.C. 154(b) by 0 days.

(21) Appl. No.: 17/584,623

(22) Filed: Jan. 26, 2022

(51) Int. Cl.
*F21V 1/06* (2006.01)
*F21V 1/16* (2018.01)
*F21V 1/00* (2006.01)

(52) U.S. Cl.
CPC ..... *F21V 1/06* (2013.01); *F21V 1/00* (2013.01); *F21V 1/16* (2013.01)

(58) Field of Classification Search
CPC ..... F21V 1/00; F21V 1/06; F21V 1/16; A41F 9/002; A41F 9/005; A41F 9/00; A41F 15/002; A41D 27/08; A41D 20/00; A44B 11/00
USPC ..... 362/351, 355, 356, 357
See application file for complete search history.

(56) References Cited

U.S. PATENT DOCUMENTS 4,646,216 A * 2/1987 Chong ..... F21V 1/00 362/357
8,468,658 B1 * 6/2013 Rife ..... A41F 9/002 24/265 AL
2002/0071281 A1 * 6/2002 Dickson ..... F21V 1/26 362/357
2015/0181965 A1 * 7/2015 Wilkins-Gaudio ..... A41F 9/02 2/338
2015/0338050 A1 * 11/2015 Thomas ..... F21V 1/14 362/351

FOREIGN PATENT DOCUMENTS

DE 2643858 A1 * 3/1978
DE 202013008352 U1 * 12/2013

* cited by examiner

*Primary Examiner* — Laura K Tso
(74) *Attorney, Agent, or Firm* — Crawford Intellecutal Property Law LLC

(57) ABSTRACT

A band for cover or decoration has a body and a securing mechanism and the securing mechanism secures the band to a lamp shade. The securing mechanism can be a clip and a looped end on opposite ends of the body, wherein the clip and the looped end engage to secure the band to the lamp shade. A method of using the band for cover has the user selecting a band, placing the band over the seam of the lamp shade, engaging the securing mechanism to secure the band to the lamp shade, and disengaging the securing mechanism for removal. A method of using the band for decoration has the user selecting one or more bands, placing the one or more bands on the lamp shade, engaging the securing mechanism to secure each band to the lamp shade, and disengaging the securing mechanism for removal.

4 Claims, 9 Drawing Sheets

BAND FOR COVER OR DECORATION

This invention relates to a band for cover or decoration of a lamp shade. Opposing ends of the band are releaseably secured to each other in a loop to stay securely in place on the lamp shade, but be released for removal. Methods of using the band for cover or decoration of a lamp shade are also disclosed.

BACKGROUND OF THE INVENTION

Lamps are common items in houses, businesses, and anywhere light is desired. Lamps provide a utilitarian function of providing additional light. Lamps also provide a decorative function in their color, style, design, or other aesthetic features. The shade of the lamp is both functional and decorative. The lamp shade is functional because it reduces the harsh light of the light bulb and diffuses the light emitting from the light bulb. It is decorative due to shape, color, pattern, or other aesthetic features. However, the lamp shade has a seam where the opposite ends of the material forming the lamp shade join together. This seam can be unsightly and diminish the aesthetic value of the lamp shade. A band that hides the seam in an aesthetic and appealing way will be a useful invention.

Also, lamp shades may be aesthetically appealing, but they may not provide as much decoration as the user wants. Or, the lamp shade may need some additional decoration to enhance its aesthetic value or to coordinate with other decorative elements of a room. Or, the lamp shade may need different aesthetic appeal to decorate for different times of the year or different holidays or for other user preference. A band that can add additional or different aesthetic appeal to a lamp shade will be a useful invention.

There may be times when a user wants to add additional decoration to the lamp shade and other times when they do not. Or, the user may want to add the decoration for a certain time of year or holiday and change the decoration for the next time of year or holiday. Or, the user may want to change the decoration as the décor of the room changes. A band for cover or decoration that can be secured to and removed and exchanged for other bands will be a useful invention.

SUMMARY OF THE INVENTION

An objective of the present invention is the provision of a band for cover or decoration that can be secured to and detached from the lamp shade.

Another objective of the present invention is the provision of a band for cover or decoration that can hide the seam of a lamp shade.

Also, an objective of the present invention is the provision of a band for cover or decoration that can add aesthetic value to a lamp shade.

A still further objective of the present invention is the provision of a band for cover or decoration that can be exchanged for another band for cover or decoration.

A method of using a band for cover or decoration to hide the seam of a lamp shade is also disclosed.

A method of using a band for cover or decoration to add aesthetic appeal to a lamp shade is also disclosed.

Other objectives and advantages of the invention will become apparent from the description of the preferred embodiments herein.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

Figure 1:
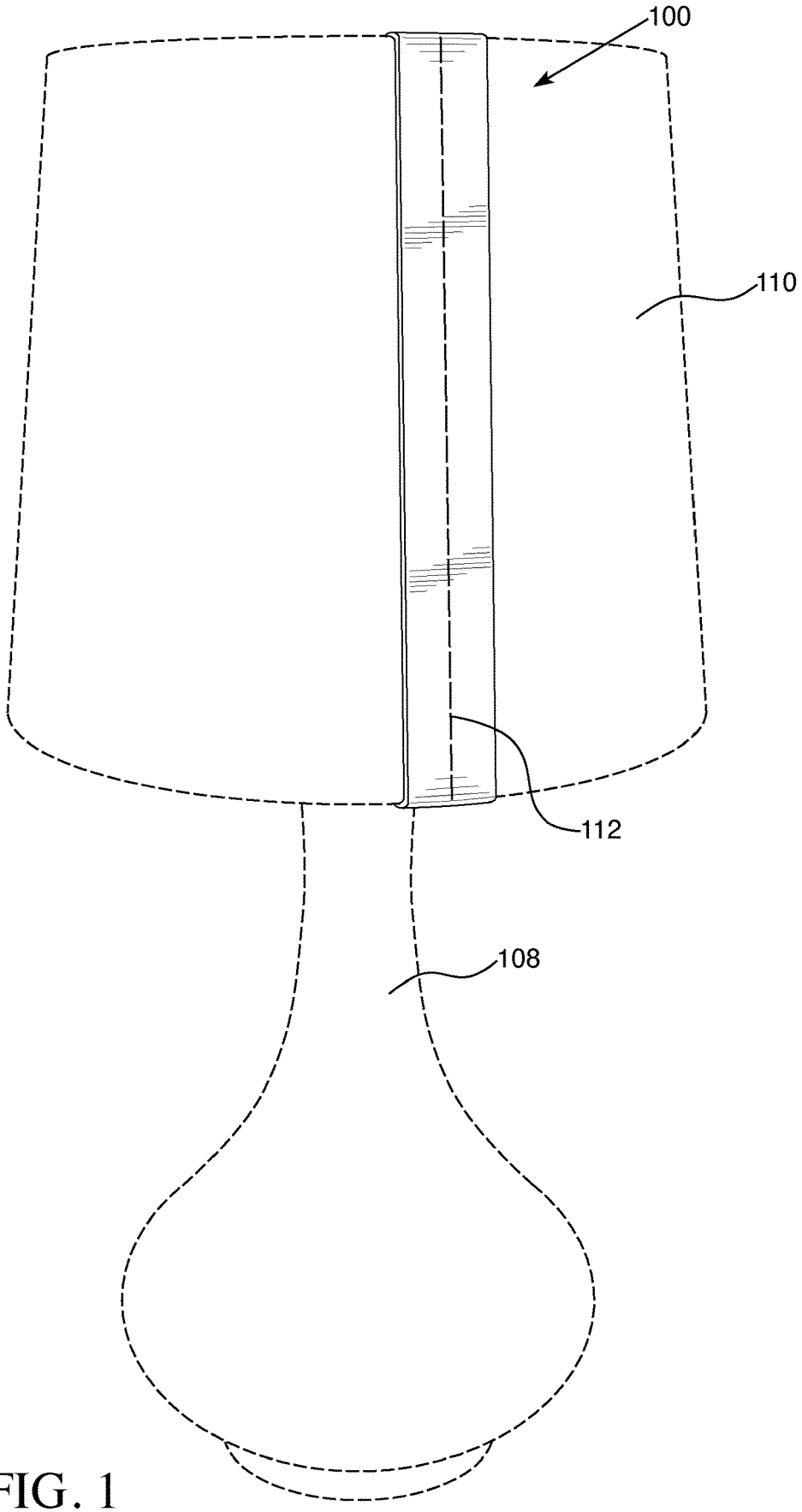
FIG. 1 depicts a perspective view of a band for cover or decoration 100 of this invention with the lamp and lamp shade depicted in phantom.
Figure 2:
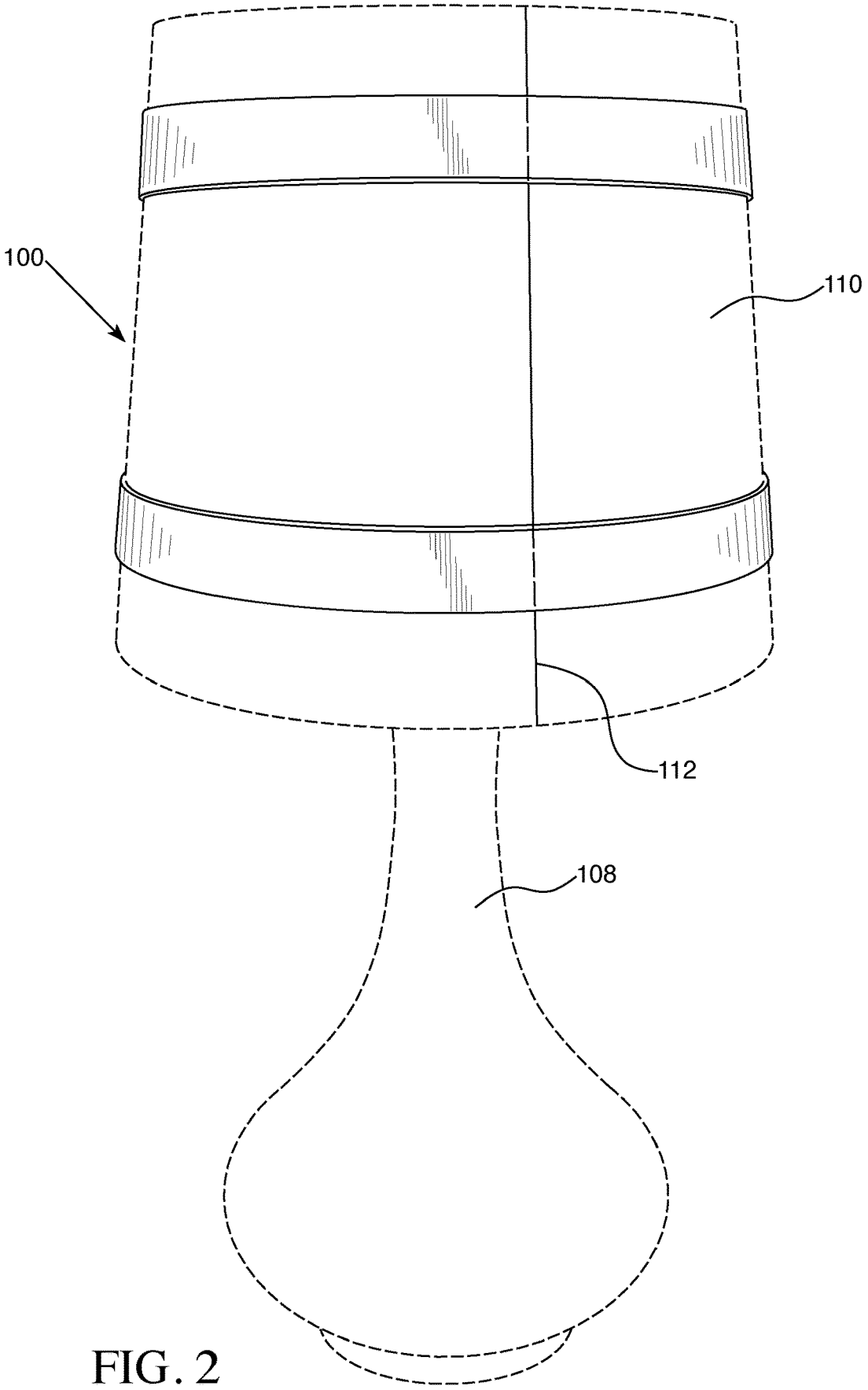
FIG. 2 depicts a perspective view of a band for cover or decoration 100 of this invention with the lamp and lamp shade depicted in phantom.
Figure 3:
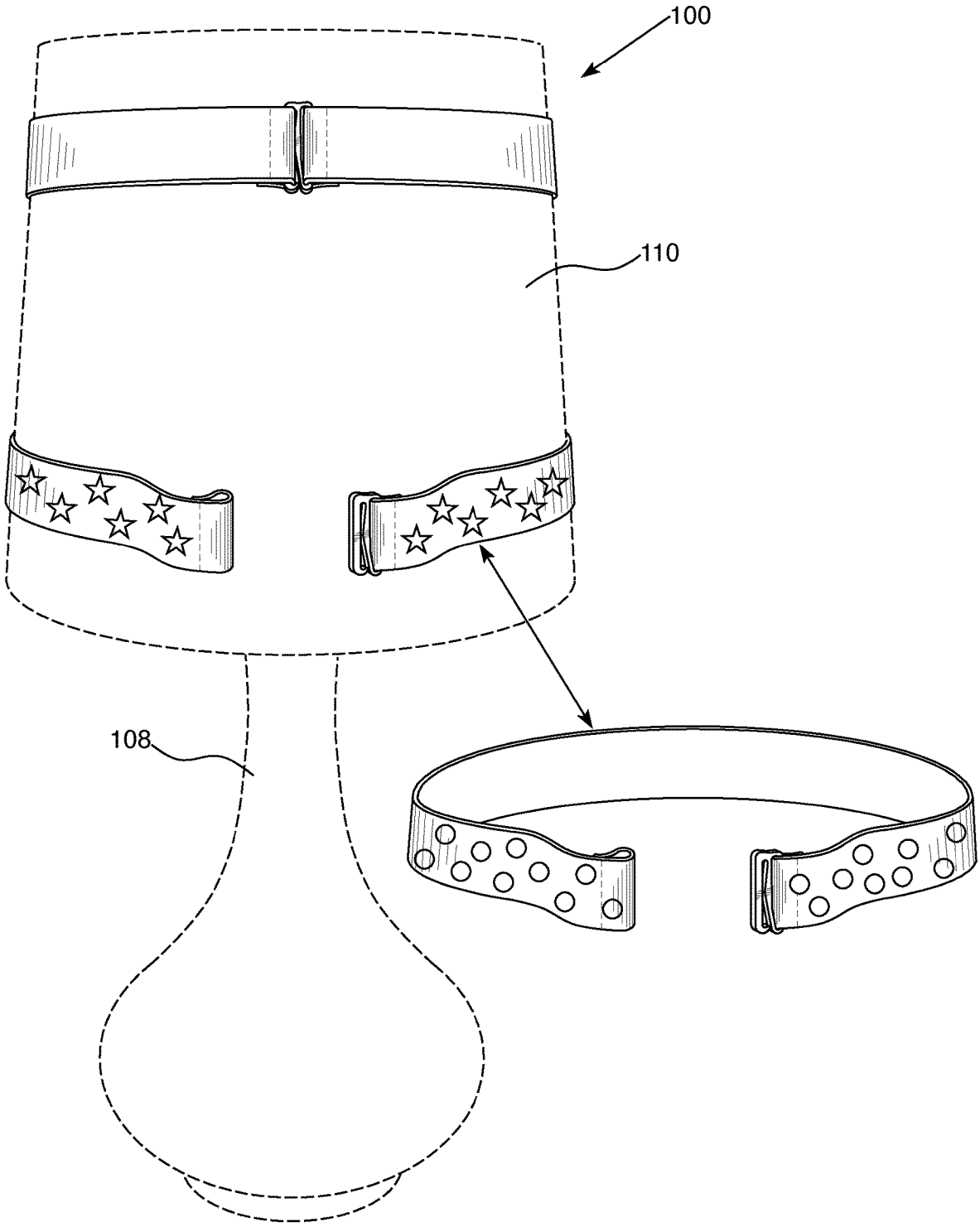
FIG. 3 depicts a perspective view of a band for cover or decoration 100 of this invention showing the exchangeability of the band for cover or decoration 100 with the lamp and lamp shade depicted in phantom.
Figure 4:
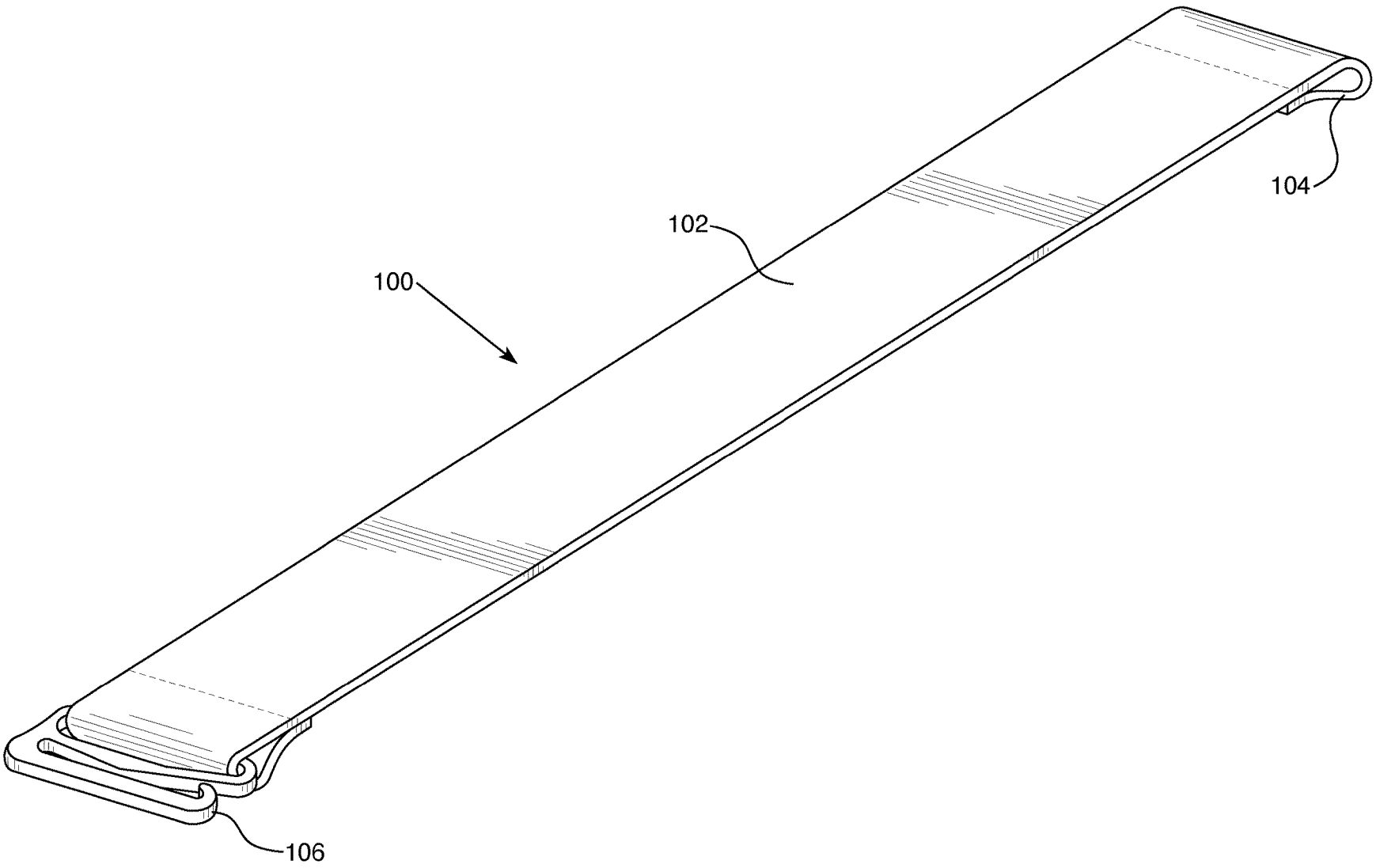
FIG. 4 depicts a perspective view of a band for cover or decoration 100.
Figure 5:
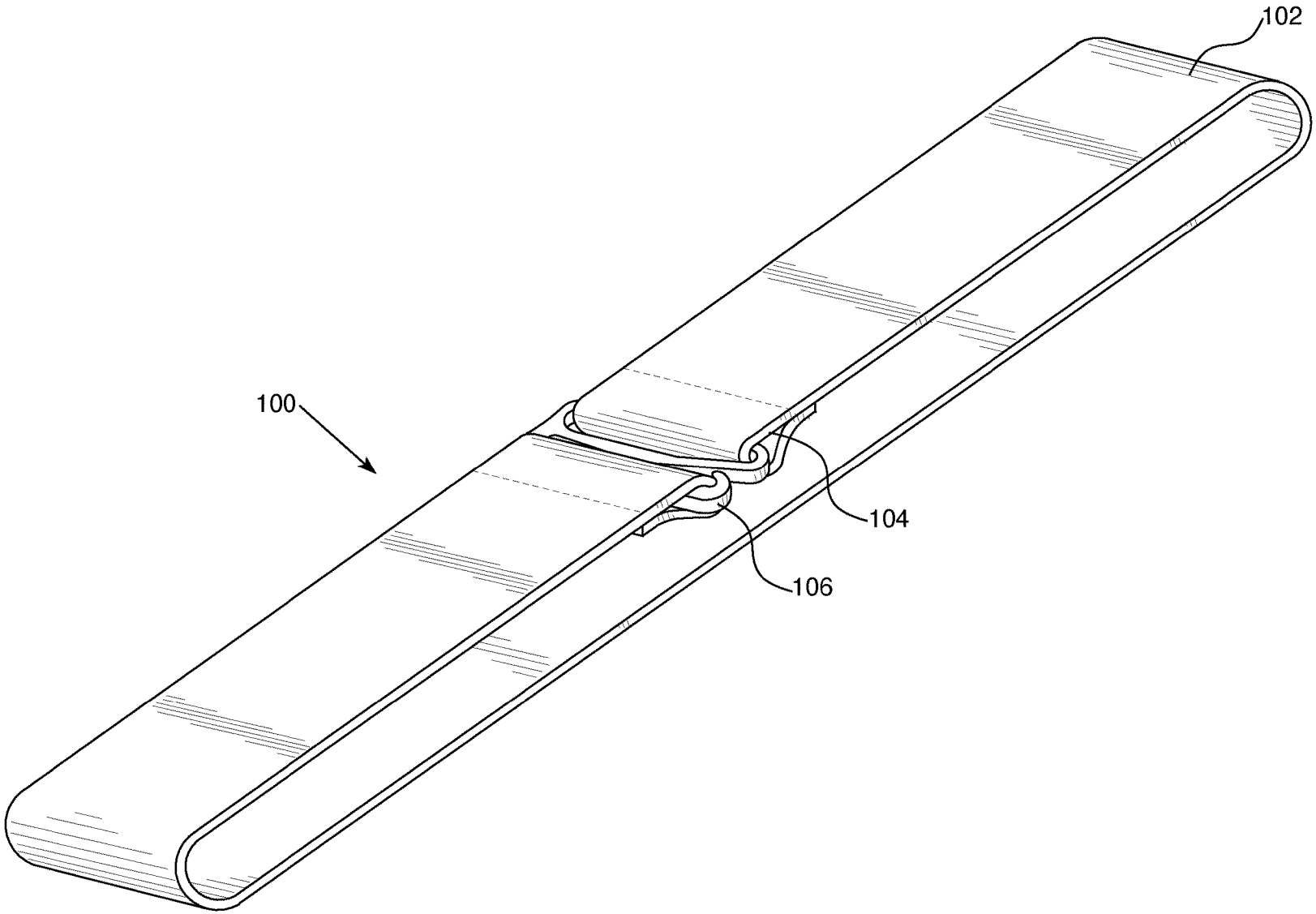
FIG. 5 depicts a perspective view of a band for cover or decoration 100 with the clip 106 attached to the looped end 104.
Figure 6:
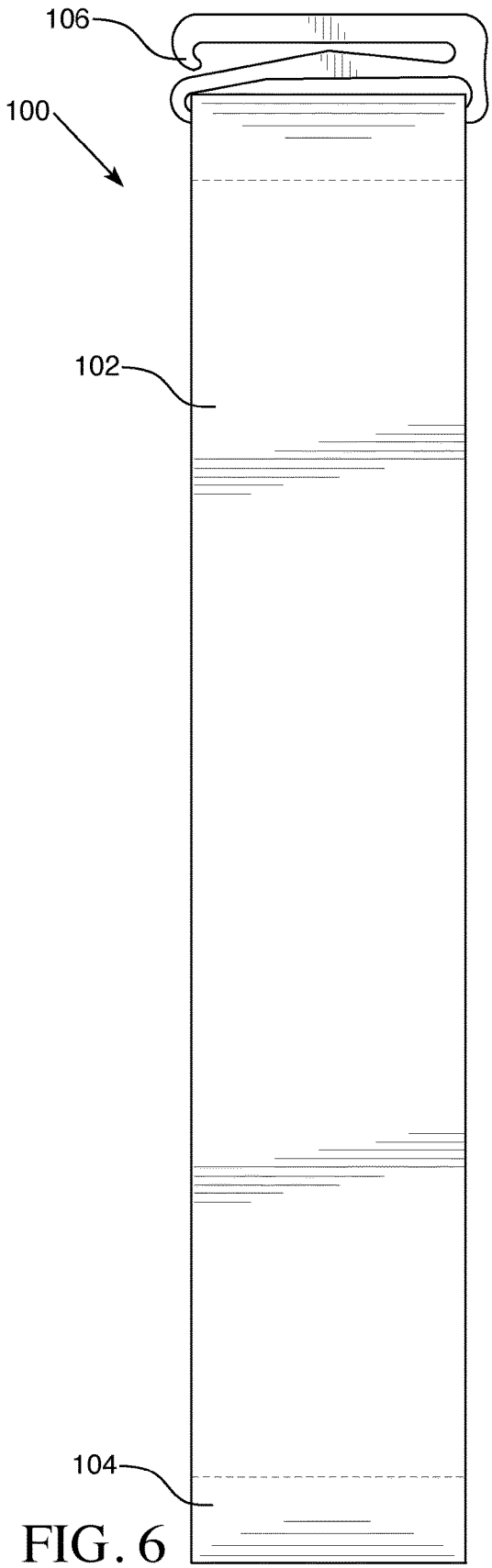
FIG. 6 depicts a front elevation view of a band for cover or decoration 100.
Figure 7:
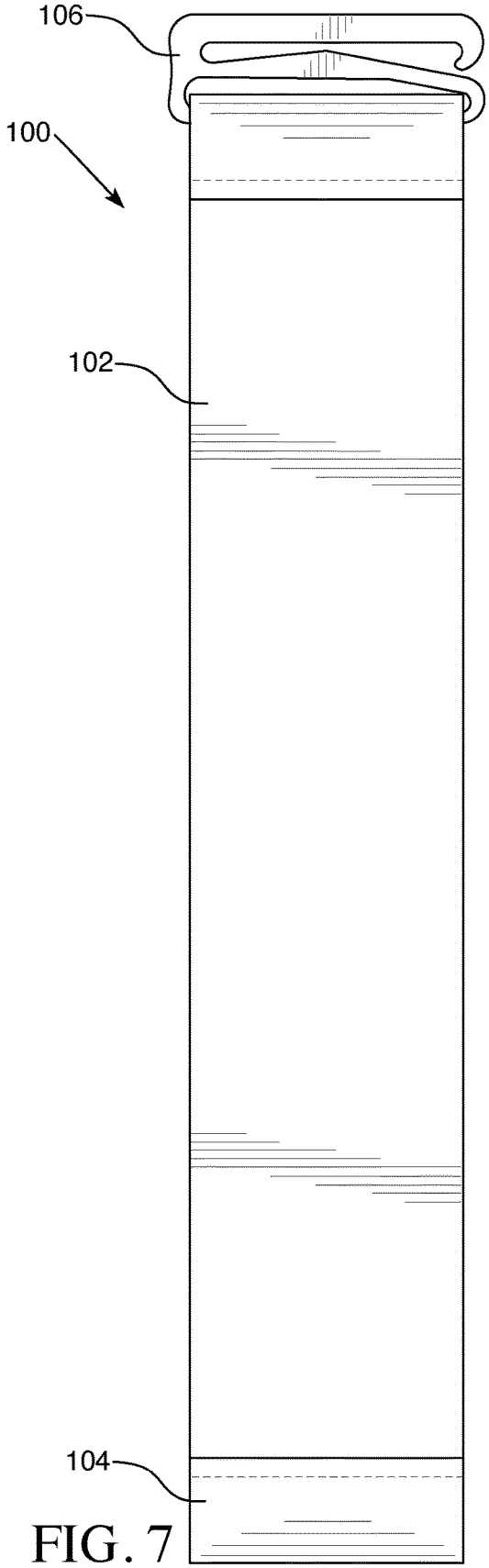
FIG. 7 depicts a rear elevation view of a band for cover or decoration 100.
Figure 8:
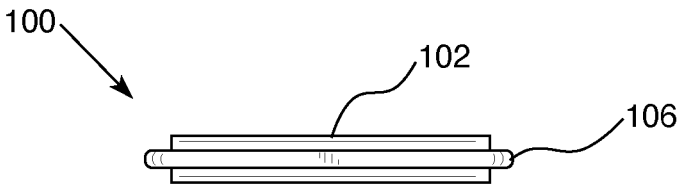
FIG. 8 depicts a top plan view of a band for cover or decoration 100.
Figure 9:
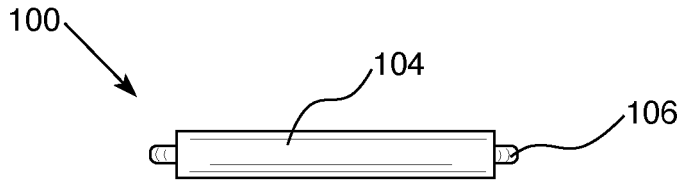
FIG. 9 depicts a bottom plan view of a band for cover or decoration 100.
Figure 10:
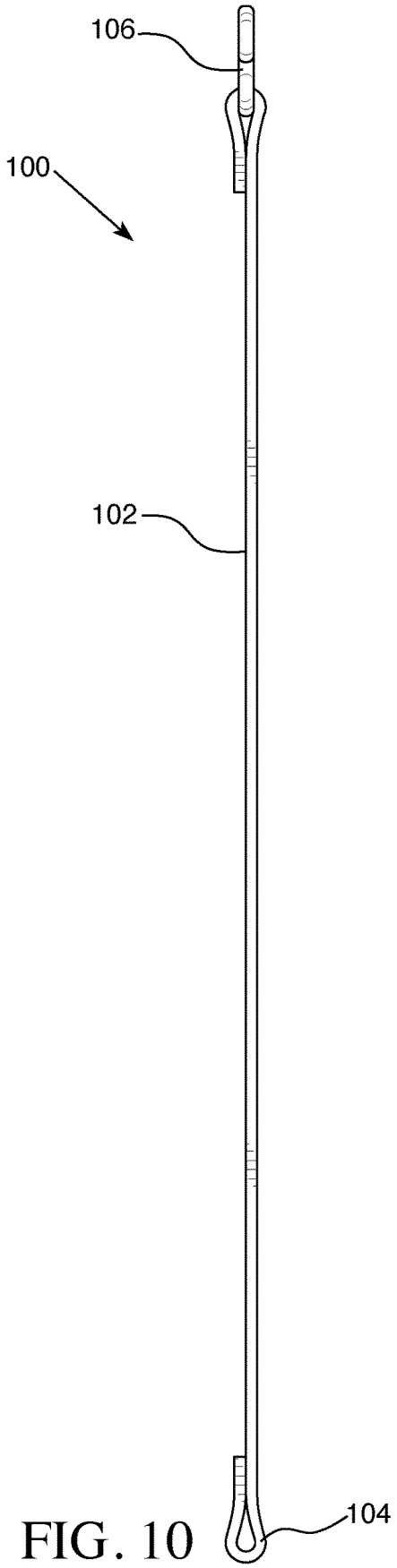
FIG. 10 depicts a left-side elevation view of a band for cover or decoration 100.
Figure 11:
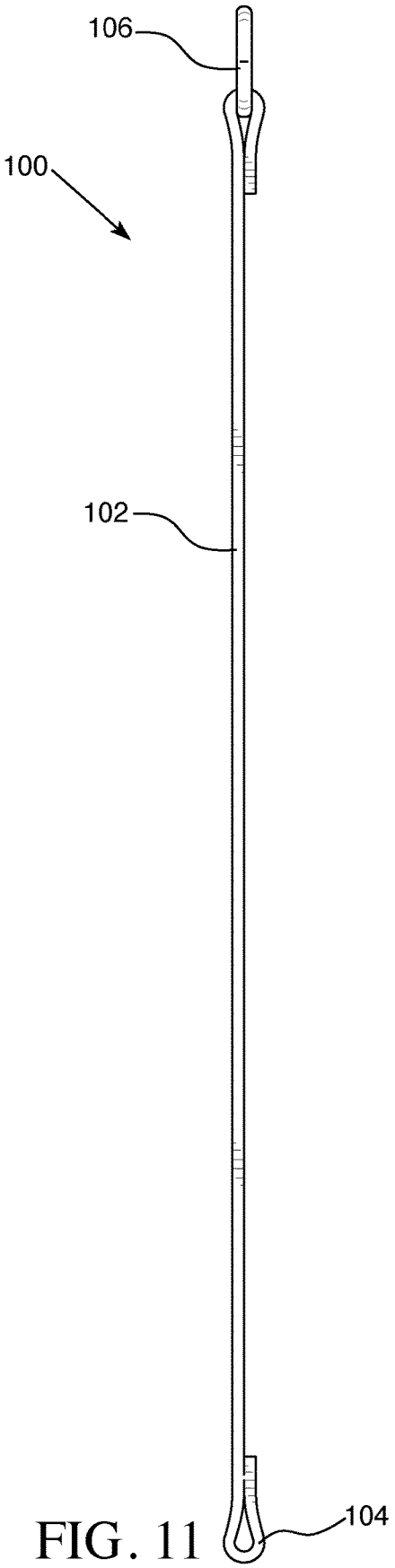
FIG. 11 depicts a right-side elevation view of a band for cover or decoration 100.

Reference will now be made in detail to several embodiments of the invention that are illustrated in accompanying drawings. Whenever possible, the same or similar reference numerals are used in the drawings and the description to refer to the same or like parts or steps. The drawings are in simplified form and are not to precise scale. For purposes of convenience and clarity only, directional terms such as top, bottom, left, right, up, down, over, above, below, beneath, rear, and front, may be used with respect to the drawings. These and similar directional terms are not to be construed to limit the scope of the invention in any manner. The words attach, connect, couple, and similar terms with their inflectional morphemes do not necessarily denote direct or intermediate connections, but may also include connections through mediate elements or devices.

Now adding FIG. 1, FIG. 2, FIG. 3, FIG. 4, FIG. 5, FIG. 6, FIG. 7, FIG. 8, FIG. 9, FIG. 10, and FIG. 11 to the consideration, the structure and function of band for cover or decoration 100 (hereinafter "band" or "band 100" or "bands 100") can be clearly seen. Band 100 has body 102, looped end 104, and clip 106.

Body 102 wraps around the lamp shade 110 and is secured in place between the cooperation of clip 106 and looped end 104. Clip 106 is depicted as a clip and looped end 104 is depicted as a looped end, but any type of securing mechanism can be used and is encompassed by this disclosure. Some additional examples of securing mechanisms include, but are not limited to, a hook and loop assembly, magnets, snaps, or buttons.

Band 100 can be placed on the lamp shade 110 along either the vertical axis (see FIG. 1) or the horizontal axis (See FIG. 2) of the lamp shade 110. Also, one or more bands 100 can be placed on the lamp shade 110 (see FIG. 2).

Body 102 is preferably made of an elastic or other flexible material so that body 102 can stretch around the lamp shade and allow clip 106 to still contact and engage with looped end 104. Body 102 can be of various lengths so that it can accommodate various lengths and diameters of lamp shades 110.

Band 100 is removable from lamp shade 110. Band 100 can be removed by disengaging clip 106 from looped end 104 or otherwise disengaging any form of securing mechanism which secures band 100 to lamp shade 110. Band 100 can be removed from lamp shade 110 and repositioned on lamp shade 110. Or, band 100 can be removed and repositioned on lamp shade 110 and one or more different bands 100 can be added to lamp shade 110. Or, band 100 can be removed from lamp shade 110 without any additional bands 100 being added. Or, band 100 can be removed from lamp shade 110 and exchanged for one or more different bands 100. The one or more different bands 100 may have a different decoration or aesthetic appeal than the original band 100 that is being replaced (See FIG. 3).

Figure 12:
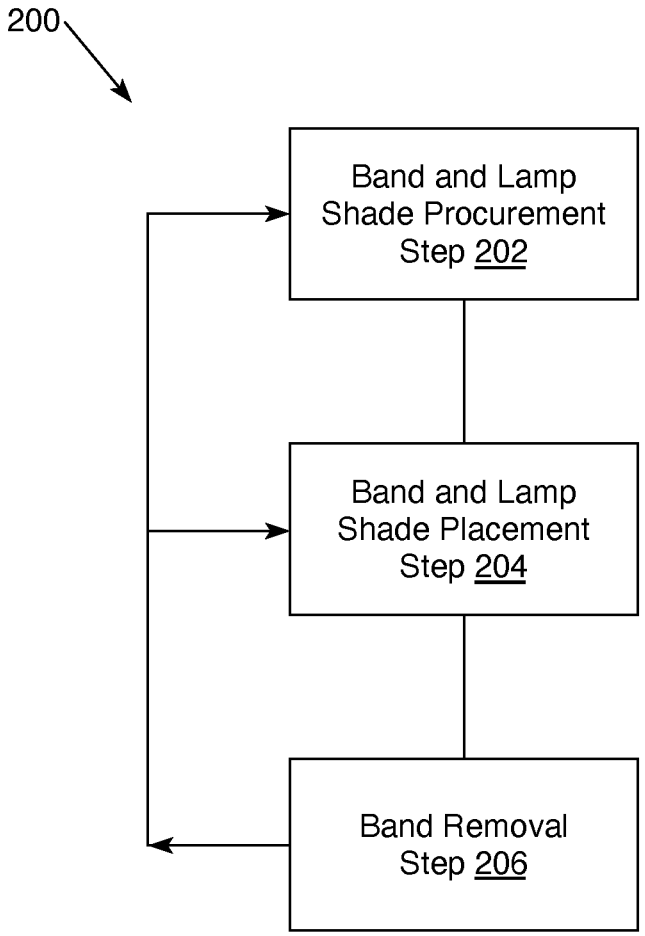
FIG. 12 depicts a block diagram of method 200.

Now adding FIG. 12 to the consideration, method 200 can be clearly seen. Method 200 has the following steps. As will be obvious to persons of ordinary skill in the art, the steps, or steps equivalent thereto, may be practiced in any reasonable order which will produce the desired result.

STEP 202 is the band and lamp shade procurement step. In this STEP 202, the user obtains one or more bands 100 and a lamp shade 110 on lamp 108. It is noted that the user may already have lamp 108 with lamp shade 110 and only needs to obtain one or more bands 100. Or, the user may have to obtain both the lamp 108 with lamp shade 110 and one or more bands 100. Or, the user may have one or more bands 100 and only need to obtain lamp 108 with lamp shade 110. Or, the user may already have both the lamp 108 with lamp shade 110 and the one or more bands 100.

STEP 204 is the band placement and securing step. In this STEP 204, the user selects the desired location to secure the one or more bands 100 on lamp shade 110. The user may only want to secure one band 100 to cover a seam 112 on lamp shade 110. Or, the user may only want to secure one band 100, either horizontally or vertically, for decoration or aesthetic appeal. Or, the user may want to secure multiple bands 100, either horizontally, vertically, or both, to cover the seam 112 of the lamp shade 110, to add decoration or aesthetic appeal, or both.

The position of the one or more bands 100 is selected and the one or more bands 100 are secured in place through clip 106 and looped end 104 or other securing mechanism.

STEP 206 is the band removal step. In this STEP 206, the one or more bands 100 are removed. Clip 106 is disengaged from looped end 104 on each band 100 (or another securing mechanism is disengaged) and the one or more bands 100 are removed from lamp shade 110 of lamp 108. Then, one or more different bands 100 may be secured or one or more of bands 100 that were on the lamp shade 110 can be repositioned (see STEP 202 and STEP 204) if desired or the lamp shade 110 of lamp 108 can be without any bands 100.

It is noted, that not all of the one or more bands 100 have to be removed at the same time. Some bands 100 can be removed and either no additional bands 100 are added or one or more additional bands 100 are added. Or, one or more of the bands 100 that were on lamp shade 110 can be repositioned and either no additional bands 100 are added or one or more additional bands 100 are added (see STEP 202 and STEP 204). This process can continue as many times as desired.

While various embodiments and aspects of the present invention have been described above, it should be understood that they have been presented by way of example only, and not limitation. Thus, the breadth and scope of the present invention should not be limited by any of the above exemplary embodiments.

This application—taken as a whole with the abstract, specification, claims, and drawings being combined—provides sufficient information for a person having ordinary skill in the art to practice the invention as disclosed herein. Any measures necessary to practice this invention are well within the skill of a person having ordinary skill in this art after that person has made a careful study of this disclosure.

Because of this disclosure and solely because of this disclosure, modification of this device can become clear to a person having ordinary skill in this particular art. Such modifications are clearly covered by this disclosure.

The invention claimed is:

1. A method for decorating a lamp shade comprising:

a) obtaining at least one band for decoration, wherein the band has a body and the body has a securing mechanism;

b) placing the at least one band for decoration in a desired position on a lamp shade, wherein the at least one band for decoration is secured in position through the engagement of the securing mechanism; and c) placing the at least one band for decoration along a vertical axis of the lamp shade.

2. A method for decorating a lamp shade comprising:

a) obtaining at least one band for decoration, wherein the band has a body and the body has a securing mechanism;

b) placing the at least one band for decoration in a desired position on a lamp shade, wherein the at least one band for decoration is secured in position through the engagement of the securing mechanism;

c) the securing mechanism being a clip and a looped end at opposite ends of the body, wherein the cooperation between the clip and the looped end secures the band for decoration to the lamp shade; and d) placing the at least one band for decoration along a vertical axis of the lamp shade.

3. A method for decorating a lamp shade comprising:

a) obtaining at least one band for decoration, wherein the band has a body and the body has a securing mechanism;

b) placing the at least one band for decoration in a desired position on a lamp shade, wherein the at least one band for decoration is secured in position through the engagement of the securing mechanism; and c) the at least one band being a plurality of bands, wherein at least one band of the plurality of bands is placed along a horizontal axis of the lamp shade and at least one band of the plurality of bands is placed along a vertical axis of the lamp shade.

4. A method for decorating a lamp shade comprising:

a) obtaining at least one band for decoration, wherein the band has a body and the body has a securing mechanism;

b) placing the at least one band for decoration in a desired position on a lamp shade, wherein the at least one band for decoration is secured in position through the engagement of the securing mechanism;

c) the securing mechanism being a clip and a looped end at opposite ends of the body, wherein the cooperation between the clip and the looped end secures the band for decoration to the lamp shade; and d) the at least one band being a plurality of bands, wherein at least one band of the plurality of bands is placed along a horizontal axis of the lamp shade and at least one band of the plurality of bands is placed along a vertical axis of the lamp shade.

* * * * *